US005768854A

United States Patent [19]

Nannini et al.

[11] Patent Number: 5,768,854

[45] Date of Patent: Jun. 23, 1998

[54] EQUIPMENT FOR PACKAGING PRODUCTS INTERNALLY OF BOXES

[75] Inventors: Luciano Nannini, Casalecchio di Reno; Giulio Strazzari, Bologna, both of Italy

[73] Assignee: Azionaria Costruzioni Machine Automatiche A.C.M.A. S.P.A., Bologna, Italy

[21] Appl. No.: 719,564

[22] Filed: Sep. 25, 1996

[30] Foreign Application Priority Data

Sep. 26, 1995 [IT] Italy ..... BO95A0450

[51] Int. Cl.[6] ..... B65B 57/06; B65B 5/00

[52] U.S. Cl. ..... 53/252; 53/55; 53/67; 53/506; 198/370.07; 198/474.1; 198/476.1

[58] Field of Search ..... 53/67, 55, 54, 53/252, 207, 377.2, 506, 566, 575; 198/370.07, 474.1, 476.1, 468.1, 456

[56] References Cited

U.S. PATENT DOCUMENTS

| | | | |
|---|---|---|---|
| 3,879,920 | 4/1975 | Langen . | |
| 4,010,595 | 3/1977 | Boyd | 53/55 |
| 4,067,172 | 1/1978 | Paules | 53/506 |
| 4,553,659 | 11/1985 | Reim et al. | 53/252 |
| 4,578,927 | 4/1986 | Scarpa et al. . | |
| 4,817,779 | 4/1989 | Beck et al. | 53/252 |
| 4,982,556 | 1/1991 | Tisma | 53/506 |
| 5,079,876 | 1/1992 | Langen et al. | 53/506 |
| 5,551,217 | 9/1996 | Huening et al. | 53/252 |

FOREIGN PATENT DOCUMENTS

| | | |
|---|---|---|
| 187 625 | 7/1986 | European Pat. Off. . |
| 244 231 | 11/1987 | European Pat. Off. . |

*Primary Examiner*—W. Donald Bray
*Attorney, Agent, or Firm*—IP Group of Pillsbury Madison & Sutro LLP

[57] ABSTRACT

In packaging equipment suitable for packaging tableted products of a delicate nature, such as tablets of soap, each tablet is directed into a box by one of a succession of push-rods set in motion synchronously with a first feed line conveying boxes, and a second feed line conveying the products. The advancing push-rods pass initially through a diverter capable of movement between a first position and a second position, and are made as a result to follow a first guide, and a second guide respectively. The diverter is timed to alternate between the first and the second positions with the passage of each push-rod, and can be locked for a predetermined duration in the second position.

11 Claims, 3 Drawing Sheets

1
2
2
3
3
4
4
5
6
8
9'
9'
9''
10
11
12
13
13
13
14
14
15
15
16
16'
16''
17
20
22
23
24
25
25
30
38
40
40

EQUIPMENT FOR PACKAGING PRODUCTS INTERNALLY OF BOXES

BACKGROUND OF THE INVENTION

The present invention relates to an item of equipment for packaging products internally of boxes. More specifically, though not exclusively, the present invention finds useful application in the packaging of particularly delicate products such as, for example, tablets of soap.

Reference is made in particular to equipment typically comprising a first feed line conveying boxes, a second feed line synchronized with the first feed line and conveying products, a plurality of push-rod elements advanced in succession and synchronously with the feed lines, a diverter element positioned to engage the advancing push-rod elements and capable of movement between a first position, selecting an active path which the push-rod elements are made to follow and along which each push-rod element is caused to direct a respective product into a corresponding box, and a second position from which the push-rod elements are made to follow an inactive path. A sensor is arranged to detect an error situation affecting either the box or the product about to be packaged by a given push-rod element.

The prior art already embraces equipment as outlined above, wherein under normal operating conditions the diverter element will remain motionless in the first position.

In the event that the sensor should detect an error situation requiring a given push-rod element to be directed onto the inactive path (for instance, a box missing on the first feed line), the diverter element is caused to switch to the second position by suitable actuator means, such as a double-acting cylinder. Once in engagement with the diverter element, consequently, the push-rod element in question is made to follow the inactive path. The diverter element is returned by the actuator means to the first position immediately after the passage of this same push-rod element and before the arrival of the next in succession. Accordingly, both the switch movement and the return movement of the diverter element must be completed within the time that separates the passage of two successive push-rod elements.

The conventional equipment described above has certain limitations and drawbacks.

Firstly, the number of products packaged per unit of time is modest, due mainly to the fact that the speed with which the diverter element alternates between the two positions is effectively limited by the inertia of the relative actuator means. This, in turn, limits the frequency with which the push-rod elements are able to advance, and therefore restricts the operating speed of the equipment as a whole.

Secondly, the diverter element tends to wear somewhat rapidly by reason of the fact that the interaction between the push-rod elements and the diverter element involves striking contact. One possible consequence of such wear, among others, is a loss of timing between the push-rod elements and the rest of the equipment. As a result, the diverter element requires servicing periodically.

SUMMARY OF THE INVENTION

The object of the present invention is to overcome the limitations and drawbacks of the prior art described above, by providing equipment such as will package a high number of products per unit of time.

The stated object is realized in equipment according to the invention for packaging products internally of boxes, comprising a first feed line, conveying boxes, a second feed line synchronized with the first feed line and conveying products, a plurality of push-rod elements advanced in succession and synchronously with the two feed lines, a diverter element positioned to engage the advancing push-rod elements and capable of movement between a first position, selecting an active path which the push-rod elements are made to follow and along which each push-rod element is caused to direct a respective product into a corresponding box, and a second position from which the push-rod elements are made to follow an inactive path. Also a sensor is arranged to detect an error situation affecting the box or the product about to be packaged by a given push-rod element.

Advantageously, the equipment disclosed comprises transmission means by which the diverter element is caused to alternate periodically between the first and the second position, synchronously with the passage of the push-rod elements, and inhibiting means such as can be piloted by the sensor to restrain the diverter element in the second position for a given duration.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
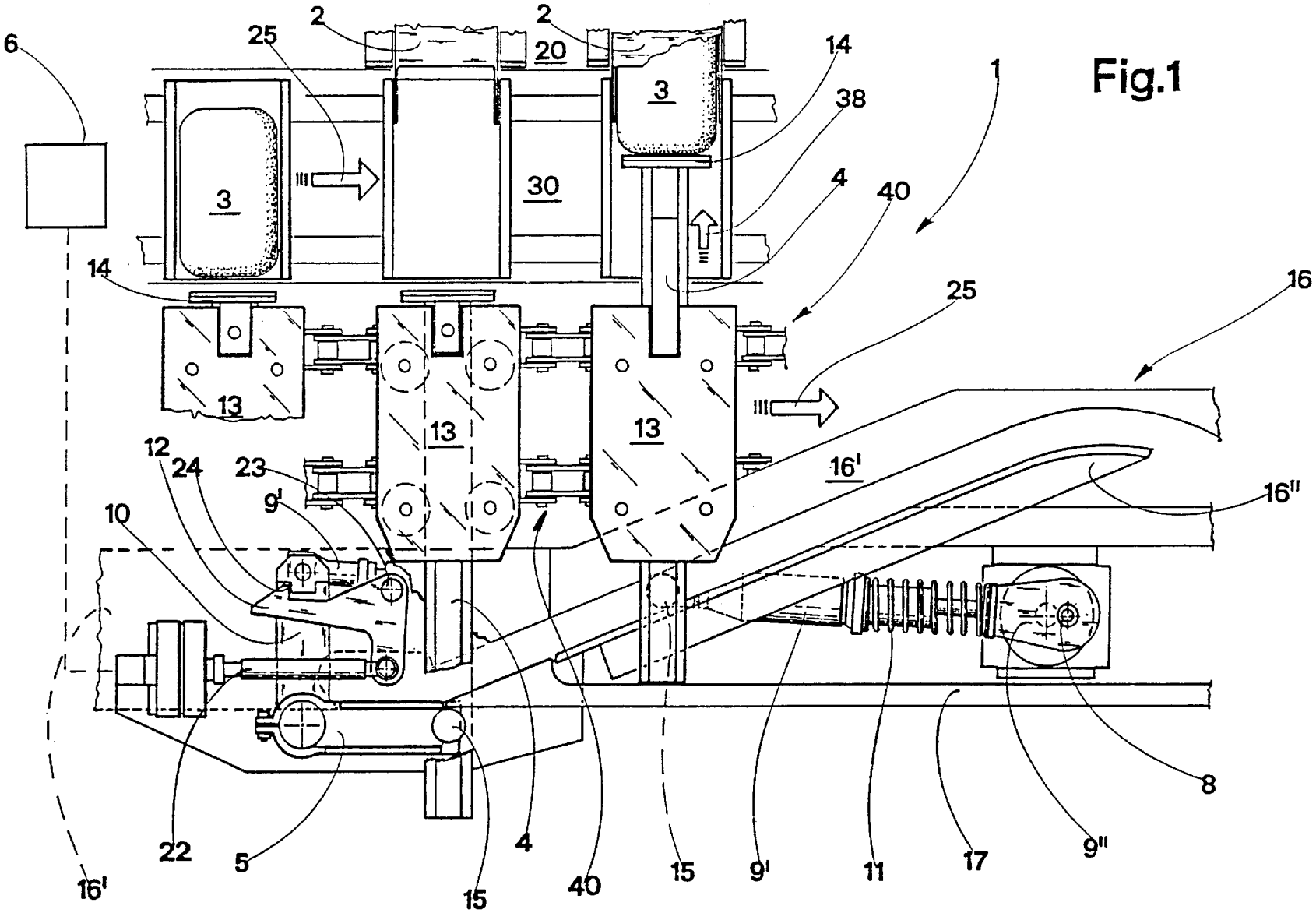
FIG. 1 is a plan view of equipment according to the present invention, in which certain parts are omitted better to reveal others.

With reference to the accompanying drawings, the numeral 1 denotes equipment, in its entirety, for packaging products 3 in respective boxes 2; such products appear as tablets of soap in the example illustrated.

The equipment 1 comprises a first feed line conveying boxes 2 and a second feed line conveying products 3, denoted 20 and 30 respectively. The two feed lines are timed one with another in such a way that each box 2 advances at a given velocity and in a given direction, denoted 25, flanked by a respective product 3.

The numeral 40 denotes a chain conveyor carrying a plurality of supports 13 set apart one from the next at a regular and predetermined distance. The chain operates in a closed loop as indicated to advantage in FIG. 3, which shows a token number of the supports 13 only.

Figure 3:
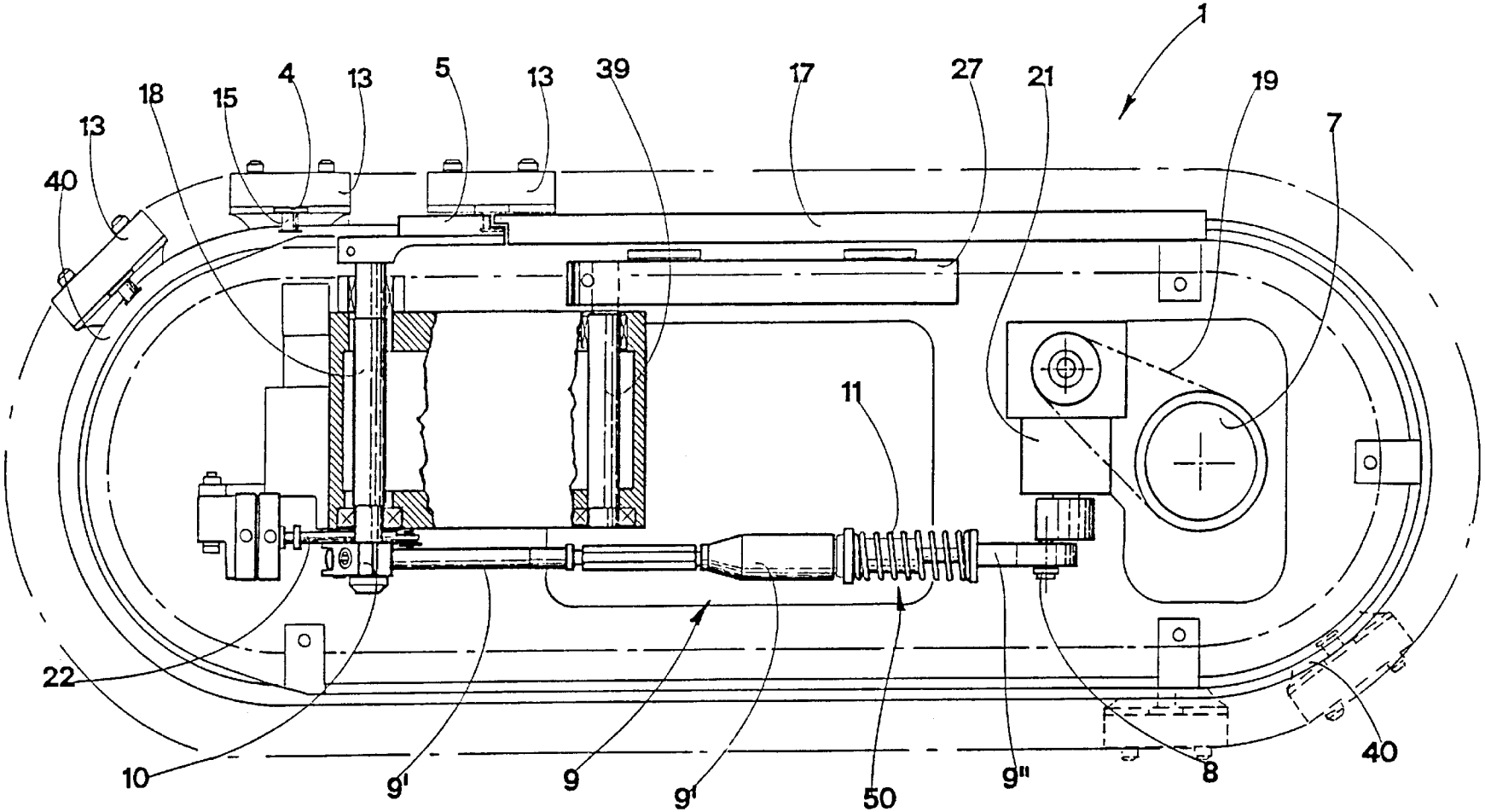
FIG. 3 shows the equipment of FIGS. 1 and 2 in a side elevation.

The supports 13 are advanced in succession along the feed direction 25 by the conveyor 40, synchronously with the feed lines 20 and 30. Each support 13, in its turn, carries a slidable push-rod element 4 of which the sliding action occurs in a direction 38 normal to the feed direction 25; the single push-rod element 4 is furnished at one end with a plate 14, positioned to interact with the product 3, and at the opposite end with a downwardly directed roller 15 (FIG. 3).

The equipment 1 also comprises a first guide 16 and a second guide 17, of which the function is to interact with each successive roller 15 in such a way as will cause the associated push-rod element 4 to follow an active or an inactive path respectively. In effect, the first guide 16 occasions a sliding movement of the push-rod element 4 in relation to the corresponding support 13, thereby causing the plate 14 to enter into contact with a product 3 advancing along the second feed line 30 and direct it into a respective box 2 advancing along the first feed line 20. Conversely, a push-rod element 4 following the second guide 17 will make no contact with a product 3.

The numeral 5 denotes a diverter element positioned to engage the rollers 15 of the advancing push-rod elements 4. The diverter element 5 is rotatable about a vertical axis between a first position illustrated in FIG. 2 and a second position illustrated in FIG. 1.

When the diverter element 5 is in the first position, the roller 15 of an advancing push-rod element will be directed onto the first guide 16 (active path). With the diverter element 5 occupying the second position, on the other hand, the roller 15 is directed onto the second guide 17 (inactive path).

Figure 2:
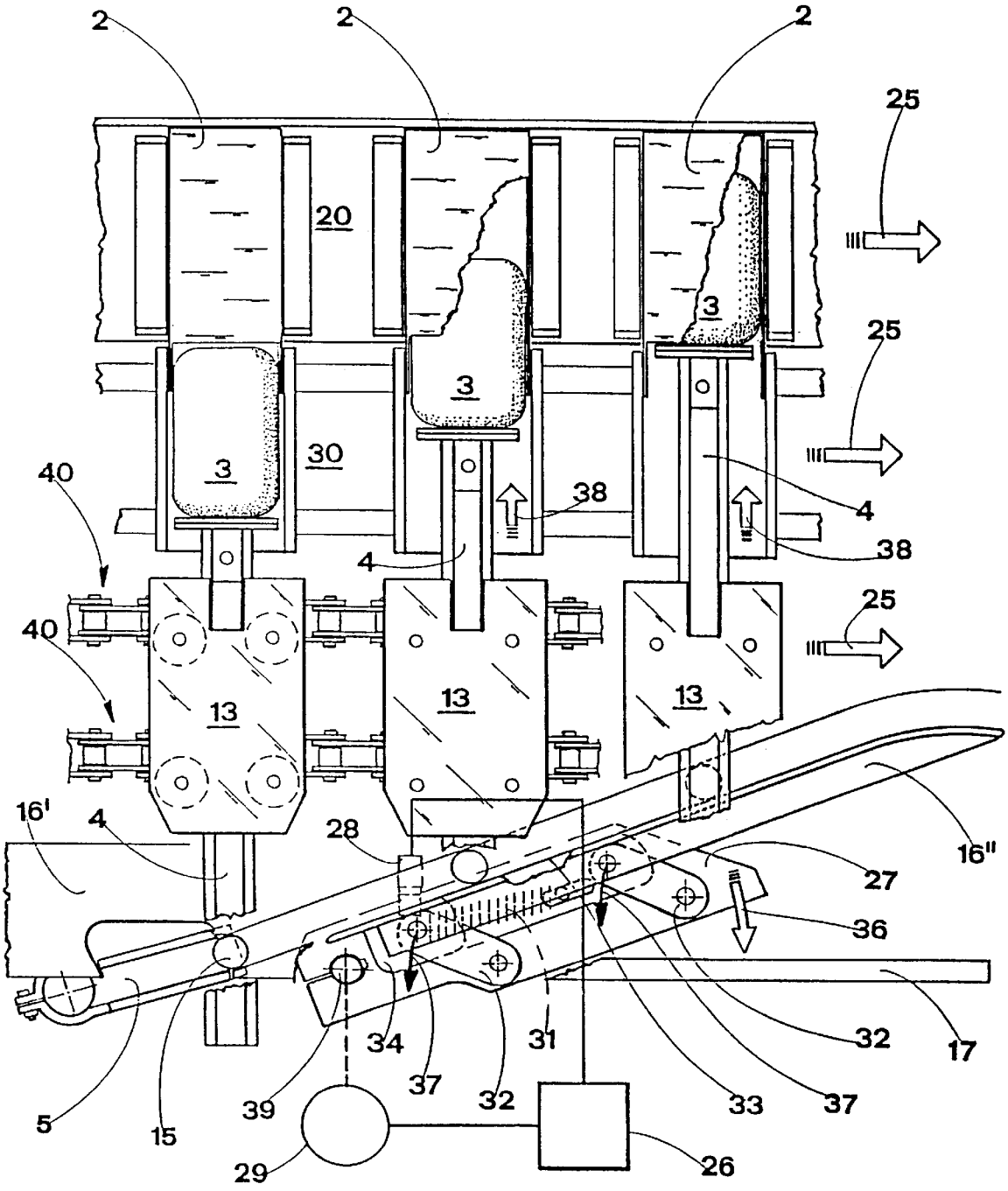
FIG. 2 shows a detail of FIG. 1, with the equipment in a different operating configuration.

The equipment also comprises a sensor 6, conventional in embodiment and indicated schematically in FIG. 1, such as will monitor the two feed lines 20 and 30 and detect any error situation affecting either the box 2 and/or the product 3 about to be packaged by a given push-rod element 4; a typical situation might be, for example, the absence of a box 2 or of a product 3. For the equipment 1 then to continue operating correctly, the respective push-rod element 4 must be diverted onto the second guide 17, hence along the inactive path. The features described thus far are common both to the equipment disclosed and to equipment embraced by the prior art.

The equipment 1 according to the invention comprises transmission means 50, 18, 21, 7 by which the diverter element 5 is caused to alternate periodically between the first position and the second position synchronously with the passage of the push-rod elements 4. Illustrated in FIG. 3, such transmission means comprise a mechanism 50 by which the continuous rotation of a shaft 7 driving the chain conveyor 40 is converted in such a manner as to produce alternating angular movement at a shaft 18 rigidly associate d with the diverter element 5.

More precisely, the mechanism 50 comprises a crank 8, a connecting rod 9 and a rocker arm 10, of which the crank 8 is connected to the drive shaft 7 by way of a belt 19 and a speed reducer 21. The rocker arm 10 is rigidly associated with the shaft 18 of the diverter element 5.

Also forming part of the mechanism are release means serving to uncouple the diverter element 5 from the d rive shaft 7. Such means comprise two coaxial parts of the connecting rod 9, denoted 9' and 9", which are joined by a spring element 11; the same two parts 9' and 9" are also rendered capable of sliding motion, one relative to the other, in the presence of a force sufficient to deform the spring element 11.

The equipment further comprises inhibiting means 12 and 22 by which the diverter element 5 can he held at the second position for a predetermined duration in response to a signal from the sensor 6. Such means comprise a catch 12 rotatable about a fixed pivot 23 and capable of movement, produced by a cylinder 22, between an active position (that of FIG. 1) in which the catch 12 itself is caused to interact with the diverter element 5 while in the second position, thus disallowing its return to the first position, and an inactive position in which there is no interaction with the diverter element 5. In the active position, the catch 12 locates in a recess 24 afforded by the rocker arm 10. The operation of the cylinder 22 is piloted by the sensor 6.

Also forming part of the equipment 1 disclosed are safety means serving to isolate the products 3 from the action of the push-rod elements 4 once the applied pushing force registers at a preset limit value. Such means comprise a frame 27, a movable portion 16" of the first guide 16, a spring element 31, two links 32, a locating surface 33 provided by the frame 27, and a sensor 28.

The first guide 16 also comprises a stationary portion, denoted 16' in the drawings.

The frame 27 is associated rigidly with the top end of a shaft 39 capable of rotation about a vertical axis. The shaft 39, in its turn, is coupled to a motor 29, as illustrated schematically in FIG. 2, thus rendering the frame 27 rotatable in the direction denoted 36 between an operating position, indicated in FIG. 2, and an idle position in which the movable portion 16" of the guide makes no contact with the push-rod elements 4.

The two links 32 are disposed mutually parallel, each pivotably associated with the frame 27 and with the movable portion 16" of the first guide 16. Thus, the frame 27, the links 32 and the movable portion 16" of the guide 16 form a quadrilateral linkage in which the movable guide portion 16" is translatable relative to the frame 27 and parallel with itself.

The aforementioned locating surface 33 is provided by a slot 34 in the frame 27, which also accommodates the spring element 31. Operating thus between the frame 27 and the movable portion 16" of the first guide 16, the spring element 31 serves to maintain the movable portion 16" in a position of engagement, tensioned against the locating surface 33, whereby the push-rod elements 4 and the relative portion 16" of the guide are caused to interact.

In practice, the spring element 31 and the locating surface 33 together constitute control means designed to maintain the movable portion 16" of the first guide in the position of engagement. Such means will subject the movable portion 16" to a force of predetermined strength, opposing the force applied by the push-rod elements 4.

In the event that the action of the spring element 31 should be overpowered by the reaction of the push-rod elements, the movable portion 16" of the guide 16 will be distanced from the operating position, causing the links 32 to rotate in the direction denoted 37.

The sensor 28 of the safety means serves to detect any shift in position of the movable portion 16" of the guide, relative to the frame 27, and is connected by way of a control unit 26 to the motor 29. Whenever the movable portion 16" is distanced from the operating position, the sensor 28 triggers the movement of the frame 27 toward the idle position.

The operation of the equipment will now be described. Under normal operating conditions, that is, in the absence of any signal from the sensor 6 indicating an error situation, the catch 12 remains in the inactive position and the diverter element 5 will continue to alternate between the first and the second position at a frequency corresponding to the frequency with which the push-rod elements 4 are advanced. The alternating movement of the diverter element 5 is produced by the motor 7 in combination with the mechanism 50 described above.

The spring element 11 possesses a rigidity such that any deformation will remain negligible during normal operation.

The alternating movement of the diverter element 5 is timed in relation to the advancing movement of the push-rod elements 4 in such a way that the successive rollers 15 will enter and quit the diverter element 5 substantially when in the second position and when in the first position, respectively. In this way, wear on the diverter element 5 resulting from repeated contact with the rollers 15 is attenuated significantly, and the maintenance requirement in respect of the diverter element 5 also much reduced in comparison with prior art solutions.

As the diverter element 5 regains the second position in readiness to engage the roller 15 of a successive push-rod element 4, the previous roller 15 continues along the first guide 16, taking the respective push-rod element 4 toward a respective product 3.

Once a product 3 has been directed into the box 2, the respective push-rod element 4 is caused to retract by the stationary portion 16' of the first guide 16, and made thus to slide in the direction opposite to that indicated by the arrow 38.

In the event that the sensor 6 should detect an error situation, such as a missing box 2 on the first feed line 20, the respective push-rod element 4 must not be brought into contact with the corresponding product 3 but made instead to follow the second guide 17 and therefore the inactive path.

In this instance, the equipment 1 operates as follows. As the roller 15 of the push-rod element 4 in question enters the diverter element 5, currently in the second position, the catch 12 will be rotated by the relative cylinder 22 and caused almost instantaneously to take up the active position, engaging the recess 24 of the rocker arm 10 and as a result restraining the diverter element 5 in the second position.

The diverter element 5 remains locked in the second position at least until the roller 15 has run through and onto the second guide 17.

At the same time, the spring element 11 of the rod 9 will deform, thereby uncoupling the rocker arm 10 from the action of the crank 8. Once the crank 8 regains the position shown in FIG. 1, the catch 12 will be returned to the inactive position by the cylinder 22, releasing the rocker arm 10 and restoring the connection between the diverter element 5 and the drive shaft 7. Normal operation is resumed at this point, with the diverter element 5 ready to receive the roller 15 of the next push-rod element 4 and all other elements of the equipment 1 faultlessly timed one with another. The diverter element 5 and the push-rod elements 4 are associated in such a way that the alternating movement of the one is subordinate to the linear movement of the others, and accordingly, faultless timing between the diverter element 5 and the push-rod elements 4 will always be ensured.

With the facility of uncoupling the diverter element 5 from the drive shaft 7, furthermore, the alternating movement of the diverter element 5 can be inhibited for the appropriate duration without interrupting the advancing movement of the push-rod elements 4.

Both the locking movement and the releasing movement of the catch 12 can be brought about at relatively high speed, due to the extremely low inertia of the catch 12 itself. Consequently, the interval of time that separates the passage of two successive push-rod elements 4 can be significantly reduced by comparison with prior art solutions, and the operating speed of the equipment thus increased.

What is claimed is:

1. Equipment for packaging products internally of boxes, comprising:

a first feed line for conveying boxes;

a second feed line synchronized with the first feed line, for conveying products;

a plurality of push-rod elements arranged to be advanced in succession and synchronously with said feed lines;

a diverter element positioned to engage the advancing push-rod elements and capable of movement between a first position, for selecting an active path which said push-rod elements are made to follow and along which each push-rod element is made to direct a respective product into a corresponding box, and a second position from which said push-rod elements are caused to follow an inactive path;

a sensor for detecting an error situation affecting the respective box or the respective product about to be packaged by a respective said push-rod element;

transmission means for causing said diverter element is to alternate periodically between said first and said second position, synchronously with passage of said push-rod elements; and inhibiting means arranged to be piloted by said sensor to restrain said diverter element in said second position for a predetermined duration.

2. Equipment as in claim 1, wherein transmission means comprise:

a drive shaft for generating movement of said push-rod elements a mechanism for converting and transmitting continuous rotation of said drive shaft into and as alternating angular movement to the diverter element; and release means for uncoupling said diverter element from drive shaft.

3. Equipment as in claim 2, wherein:

said mechanism comprises a crank element connected to said drive shaft, a connecting rod, and a rocker arm connected to said diverter element; and said release means comprise two parts of the connecting rod and a spring element by which said two parts are interconnected.

4. Equipment as in claim 1, wherein:

said transmission means comprises:

a drive shaft for generating movement of said push-rod elements;

a crank element connected to said drive shaft;

a connecting rod; and a rocker arm connected to said diverter element;

said transmission means being arranged for converting and transmitting continuous rotation of said drive shaft generating the movement of said push-rod elements into and as alternating angular movement to said diverter element;

further comprising:

release means operating in conjunction with the transmission means, said release means being embodied as two parts of said connecting rod and a spring element interconnecting said two parts, for uncoupling said diverter element from said drive shaft;

inhibiting means for restraining said diverter element, said inhibiting means comprising a catch capable of movement, piloted by said sensor, between an active position in which said catch is caused to interact with said diverter element when in said second position and thus disallow return of said diverter element to said first position, and an inactive position in which there is no interaction between said catch and said diverter element.

5. Equipment as claim 1, wherein:

said transmission means are comprises:

a drive shaft for generating movement of said push-rod elements;

a crank element connected to said drive shaft;

a connecting rod; and a rocker arm connected to said diverter element;

said transmission means being arranged for converting and transmitting continuous rotation of said drive shaft generating the movement of said push-rod elements into and as alternating angular movement to said diverter element;

further comprising: release means embodied as two parts of said connecting rod and a spring element interconnecting said two parts, for uncoupling said diverter element from said drive shaft;

inhibiting means embodied as a catch capable of movement, piloted by said sensor, between an active position in which said catch is caused to interact with said diverter element when in said second position and thus disallow return of said diverter element to said first position, and an inactive position in which there is no interaction between said catch and said diverter element; and safety means for isolating said products from action of the push-rod elements when applied pushing force by said push-rod elements reaches a predetermined limit value.

6. Equipment as in claim 5, wherein said safety means comprise:

a frame arranged for movement between an operating position and an idle position;

a movable guide arranged to be distanced in relation to said frame from a position of engagement whereby, with said frame in said operating position, said push-rod elements when advancing along said active path are caused to interact with said movable guide;

control means arranged for subjecting said movable guide to a force of predetermined strength opposing action of said push-rod elements and for maintaining said movable guide in said position of engagement; and further comprising:

a sensor arranged to detect any shifting of said movable guide away from said position of engagement and thereupon cause movement of said frame to said idle position.

7. Equipment as in claim 6, wherein:

said control means by which said movable guide is maintained in said position of engagement comprise a spring element operating between said frame and said frame and said movable guide, and a locating surface provided by said frame and against which said movable guide arranged to be caused to register when in said position of engagement.

8. Equipment as in claim 6, wherein:

said movable guide is anchored permanently to said frame and arranged for translational movement parallel with itself in relation to said frame.

9. Equipment as in claim 7, wherein:

said movable guide is anchored permanently to said frame and arranged for translational movement parallel with itself in relation to said frame.

10. Equipment as in claim 8, wherein:

said movable guide is pivotably associated with two links disposed mutually parallel and respectively pivotably associated with said frame.

11. Equipment as in claim 9, wherein:

said movable guide is pivotably associated with two links disposed mutually parallel and respectively pivotably associated with said frame.

* * * * *